US005523741A

United States Patent [19]

Cane

[11] Patent Number: 5,523,741

[45] Date of Patent: Jun. 4, 1996

[54] SANTA CLAUS DETECTOR

[76] Inventor: Thomas Cane, 28 Westwood Dr., San Rafael, Calif. 94901

[21] Appl. No.: 293,673

[22] Filed: Aug. 19, 1994

[51] Int. Cl.[6] ..... G08B 23/00

[52] U.S. Cl. ..... 340/573; 362/103; 362/801; 362/802; 362/806; 36/137

[58] Field of Search ..... 340/573; 36/137; 362/103, 801, 802, 806, 808

[56] References Cited

U.S. PATENT DOCUMENTS

| | | | |
|---|---|---|---|
| 3,220,130 | 11/1965 | Falkenberg | 362/808 |
| 3,525,862 | 8/1970 | Carter | 362/808 |
| 4,823,240 | 4/1989 | Shenker | 362/808 |
| 4,833,580 | 5/1989 | Allen | 362/806 |
| 4,858,079 | 8/1989 | Ohashi | 362/806 |
| 5,033,212 | 7/1991 | Evanyk | 36/137 |
| 5,361,192 | 11/1994 | Lai | 362/806 |

*Primary Examiner*—Brent A. Swarthout
*Assistant Examiner*—Albert K. Wong
*Attorney, Agent, or Firm*—Ralph C. Francis

[57] ABSTRACT

A children's Christmas Stocking device useful for visually signalling the arrival of Santa Claus by illuminating an externally visable light source having a power source located within said device.

4 Claims, 4 Drawing Sheets

SANTA CLAUS DETECTOR

TECHNICAL FIELD

The present invention relates to a children's device having illumination means associated therewith. More particularly, the invention relates to a device for signaling the arrival of Santa Claus.

BACKGROUND OF THE INVENTION

Modern folklore includes many mystical entities such as Santa Claus, the Easter Bunny, the Tooth Fairy, etc. The most widely recognized and embraced by young children is Santa Claus—a plump, white-bearded and red-suited gentlemen who delivers presents to "good" children at Christmas time.

To young children, the arrival of Santa Claus on Christmas Eve is an event filled with joy. Indeed, it is the culmination of days filled with great anticipation and expectation.

According to modern folklore, if a child has behaved during the previous year, Santa Claus will reward the child by placing one or more Christmas presents under the Christmas tree while the child is asleep. To prepare for the arrival of Santa Claus, most households recognizing the Christmas holidays will decorate and prominently display the Christmas tree and hang (or display) various decorations, including Christmas stockings. The stockings are hung by the fireplace (i.e., where Santa enters) and are also filled with small presents and/or treats by Santa upon his arrival.

Thus, in the minds of young children, Santa Claus' arrival is denoted by the presence of Christmas presents under the tree and/or Christmas stockings filled with treats. However, none of these customary practices, nor any prior art arrangements known to applicant, provides a Christmas stocking which is capable of being selectively illuminated to signal the arrival of Santa Claus. Furthermore, there are no such prior art arrangements known to applicant which includes a light transmissive three dimensional hollow recognizable character rendition which is capable of being illuminated to signal the arrival of Santa Claus.

It is therefore an object of the present invention to provide a children's device capable of providing selective illumination to signal the arrival of Santa Claus. This is particularly important to young children, providing reassurance that the child's good behavior has in fact been rewarded by Santa Claus.

SUMMARY OF THE INVENTION

The device of the present invention generally comprises a Christmas stocking having illumination means associated therewith for signalling the arrival of Santa Claus. According to the invention, the Christmas stocking has an enclosure therein, a light source disposed on the stocking exteriorly thereof, a power source for powering the light source upon completion of an electric conduction path therebetween and switch means for selectively connecting the power source to the light source. The power source and switch means are preferably contained in the stocking enclosure.

BRIEF DESCRIPTION OF THE DRAWINGS

Further features and advantages of the Santa Claus Detector disclosed herein will become apparent from the following and more particular description of the preferred embodiment of the invention as illustrated in the accompanying drawings in which.

DETAILED DESCRIPTION OF THE INVENTION

Figure 1A:
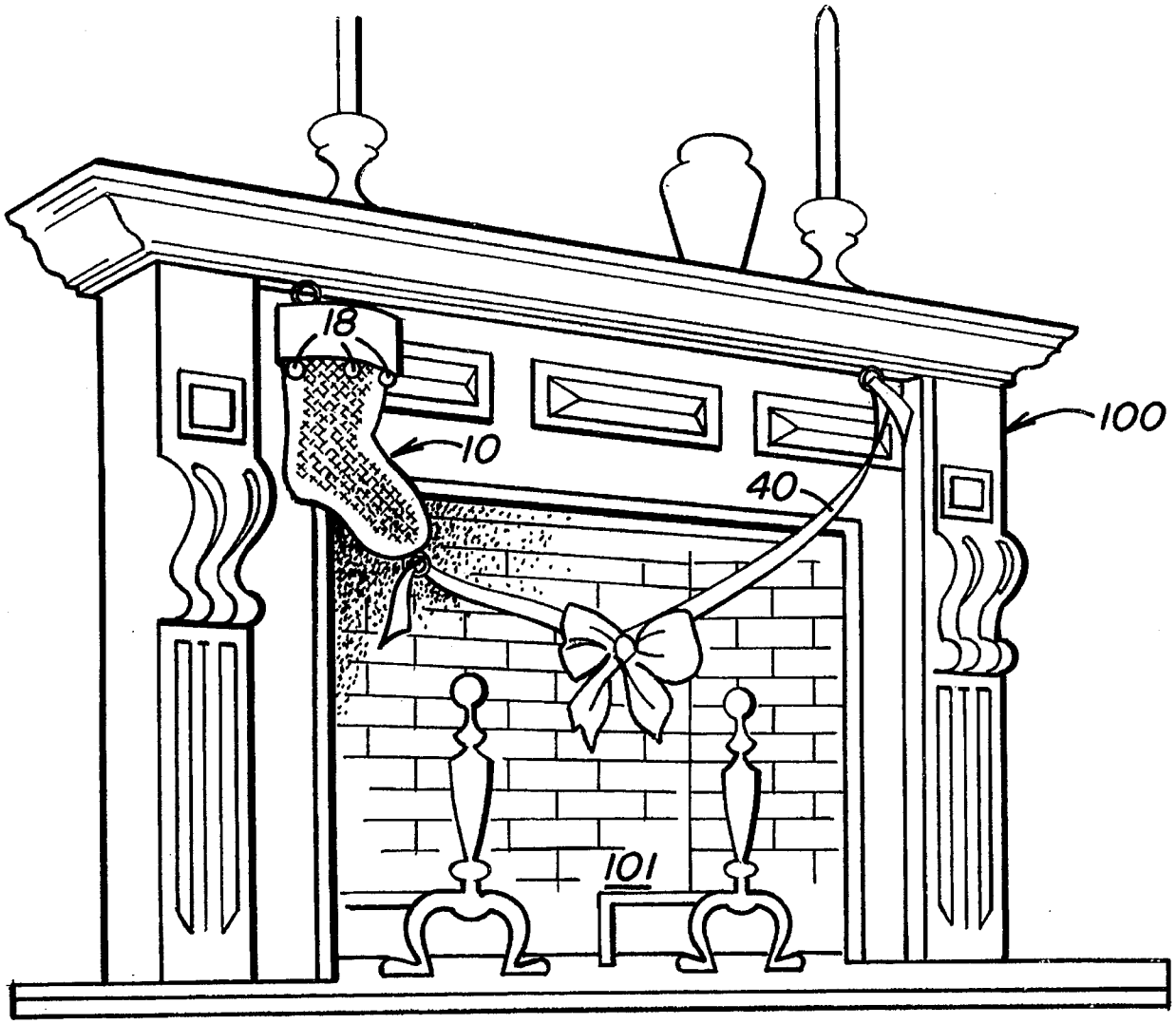
FIGS. 1A and 1B are perspective views of preferred stocking arrangements in accordance with the present invention.
Figure 2:
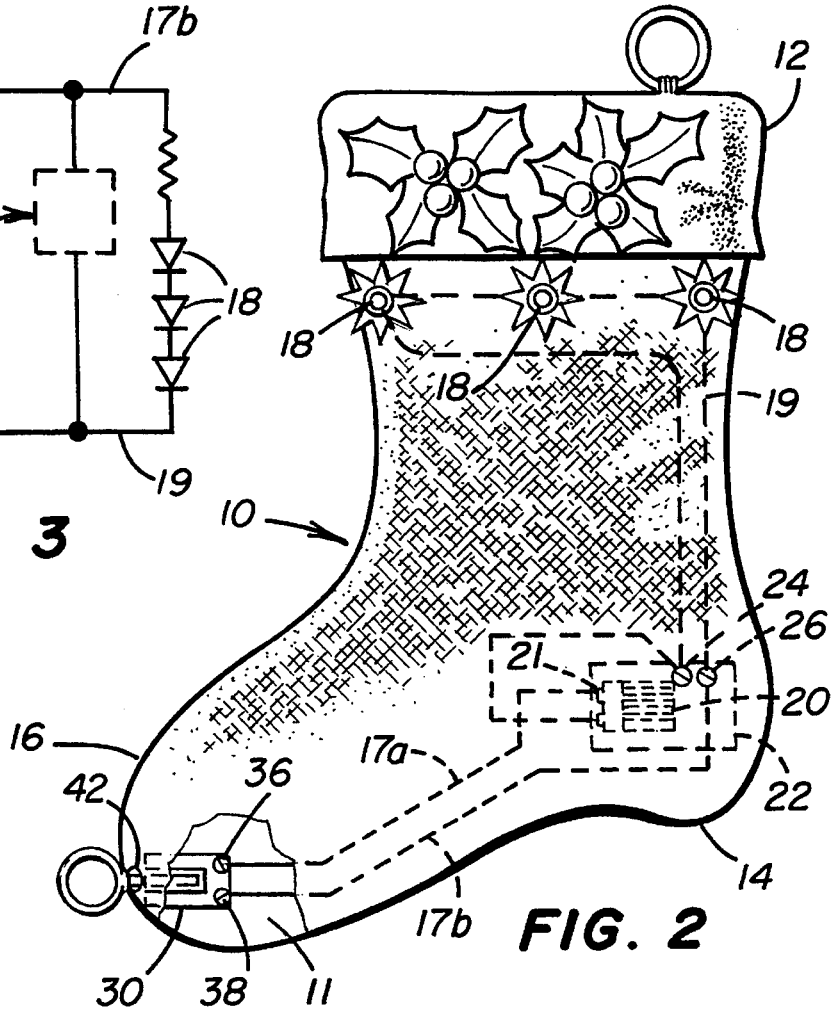
FIG. 2 is a plan view of the stocking in accordance with the present invention.

Referring now to the drawings in detail and initially to FIGS. 1A and 2 thereof, the presently preferred embodiment of the children's device, generally referred to by the numeral 10, comprises a Christmas stocking having an enclosure 11 therein to accommodate small Christmas presents/treats. The stocking 10 includes a top portion 12, a heel portion 14 and a toe portion 16. The stocking 10 is preferably constructed out of a conventional cloth or synthetic material. As will be recognized by one skilled in the art, the stocking 10 may comprise various conventional pliable materials.

As shown and preferred in FIG. 2, the stocking 10 includes a light source 18, a power source 20 for powering the light source 18 and a switch 30. In the preferred embodiment the power source 20 comprises a conventional battery. As will be described in greater detail hereinafter, the battery 20 and switch 30 are preferably mounted in the stocking enclosure 11.

Figure 3:
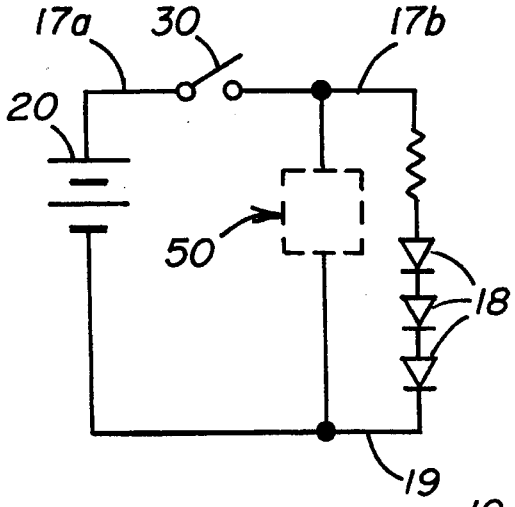
FIG. 3 is a block diagram of the preferred embodiment of the electrical circuit in accordance with the present invention.

The light source 18 of the invention preferably comprises at least one conventional light emitting diode (LED) or light bulb. More preferably, the light source 18 comprises a plurality of LED's or light bulbs operatively connected in series (via electric lead 19) as schematically illustrated in FIG. 3. As shown and preferred in FIGS. 1A and 2, the light source 18 is disposed on the exterior of the stocking 10 proximate the top portion 12 thereof. In further embodiments of the invention, not shown, the light source 18 may be disposed in the stocking enclosure 11 and positioned therein such that the light emitting therefrom is visible exteriorly of the stocking 10.

As can be seen with reference to FIG. 2, a battery housing 22 is provided to secure and position the aforementioned battery 20 in the stocking enclosure. The battery housing 22 is preferably formed of plastic or some other suitable electrical insulator. The battery housing 22 includes a pair of electrical contacts 24 and 26 for electrically connecting the battery 20 to the light source 18. As will be apparent to one skilled in the art, other means may be employed to connect the battery 20 to the light source 18.

In the preferred embodiment, the battery housing 22 is removably mounted in the stocking enclosure 11 proximate the heel portion 14 by any conventional mounting means such as a pocket in the stocking enclosure 11, a snap or by velcro strips, by way of example. Such removal will facilitate removal and replacement of the battery 20.

Figure 4:
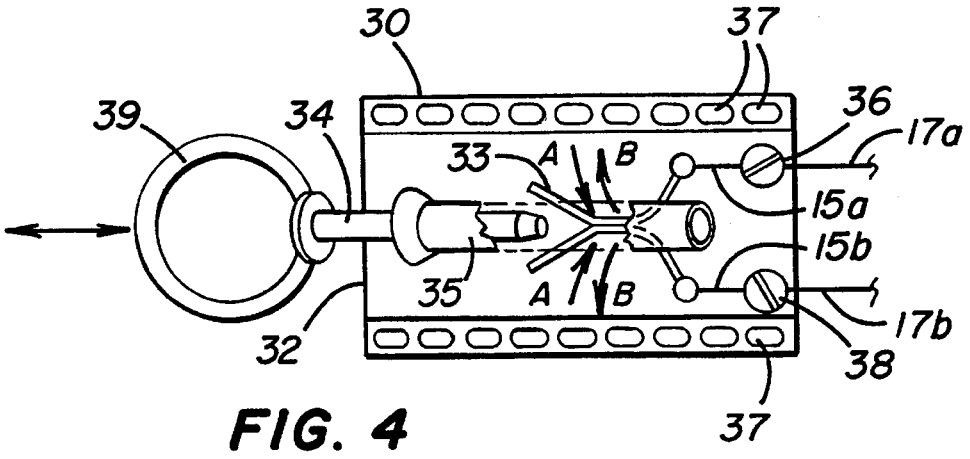
FIG. 4 is a simplified sectional view of the switch means in accordance with the present invention.

Switch 30, shown in FIG. 4, preferably consists of a resiliently biased electrical contact 33 which is normally biased in the direction of arrows A, so as to normally provide a closed circuit condition between battery 20 and light source 18. Switch 30 includes electrical contacts 36 and 38 operatively connected to contact 33 on opposite sides thereof (via electrical leads 15*a*, 15*b*).

According to the invention, one of the terminals of the battery 20 is connected to one of the electrical contacts 36, 38. The other contact (36 or 38) is employed to connect and complete the circuit between the battery 20, light source 18 and switch 30. In the preferred embodiment illustrated in FIG. 2, battery terminal 21 is connected to switch contact 36 via electrical lead 17*a*. Switch contact 38 is connected to battery contact 26 via electrical lead 17*b*, to complete the circuit between the battery 20, light source 18 and switch 30.

As further illustrated in FIG. 4, switch 30 also includes a slide pin 34 formed of plastic or some other suitable electrical insulator which is slidably mounted in switch housing 32. The switch housing 32 includes a pin guide 35 to guide and retain the slide pin 34 in the switch housing 32. Actuation of the switch 30 is accomplished by slidably pushing the slide pin 34 forward until the pin 34 engages and opens contact 33 (in the direction of arrows B) and is positioned therein so as to insulate contact 33 from battery 20 and create an open circuit condition at this point. Such an open circuit condition is schematically illustrated in FIG. 3. As will be recognized by one skilled in the art, other conventional switch means may be employed within the scope of this invention.

As can be seen with reference to FIG. 2, the switch 30 is preferably mounted in the stocking enclosure 11 proximate the toe portion 16 by conventional means such as a snap or by velcro strips. As illustrated in FIG. 4, the switch housing 32 may also include a plurality of holes 37 disposed in opposite edges thereof to facilitate conventional sticking of the switch 30 to the stocking 10.

According to the invention, a hole 42 is also provided in the stocking toe portion 16 proximate the switch 30 to accommodate the slide pin 34. The diameter of the hole 42 is preferably slightly larger than the diameter of pin 34.

As illustrated and preferred in FIG. 1A, the stocking 10 further includes an elongated flexible pull cord 40 to facilitate the actuation of the switch 30. The cord 40 may be tied to the slide pin ring 39 or attached thereto by other conventional means.

The pull cord 40 preferably comprises a strip of decorative ribbon. However, as will be recognized by one skilled in the art, the pull cord 40 may comprise various conventional materials.

In additional embodiments of the invention, the stocking 10 may include a conventional electric music generator 50 (shown in phantom in FIG. 3) capable of selectively and repeatedly playing pre-recorded music such as a Christmas carol. As illustrated in FIG. 3, the music generator 50 is preferably connected in the electrical conduction path and is similarly activated by the switch 30. The music generator 50 may be mounted in the stocking enclosure 11 by conventional means, such as the aforementioned switch 30 mounting means.

As further shown and preferred in FIG. 1, the stocking 10 is mounted (by conventional means) on the upper portion of the chimney 100 on one side thereof with the pull cord 40 positioned across the chimney opening 101, creating a barrier for Santa's entry. While the child is asleep (on Christmas Eve), one merely needs to pull on the pull cord 40 to activate the switch 30 and, hence, the light source 18 and music generator 50, if employed. Thus, when the child awakens on Christmas day he/she will assume that the pull cord 40 was pulled inadvertently by Santa Claus when he entered.

Figure 1B:
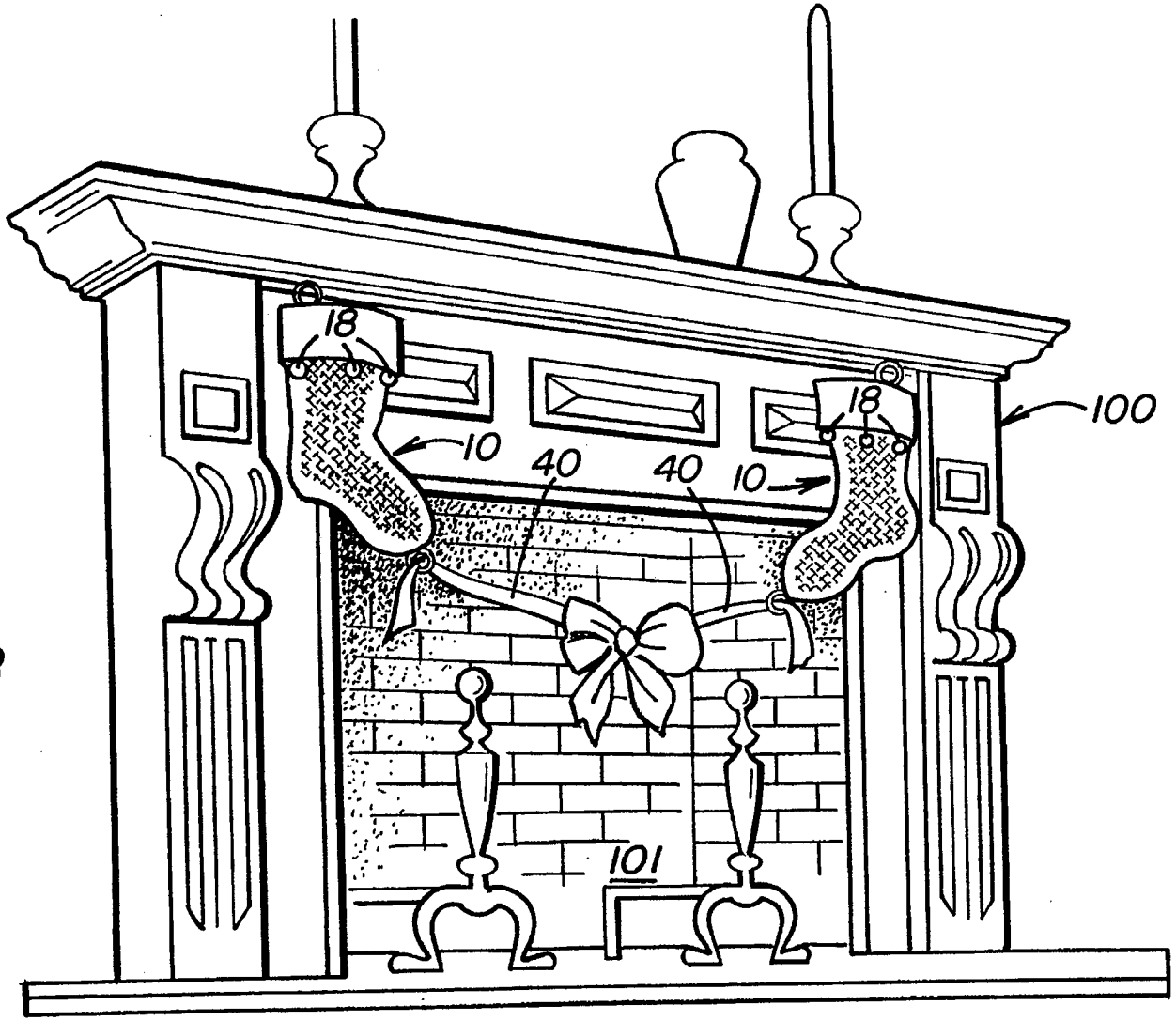

As further shown in FIG. 1B, two stockings 10 may also be employed. The two stockings 10 are similarly mounted on the upper portion of the chimney 100 on opposite sides thereof. The pull cords 40 may also be individually positioned across the chimney opening 101 or, as illustrated in Figure 1B, joined at or near the chimney opening 101 to simultaneously activate the switches contained in the respective stockings 10.

Figure 5:
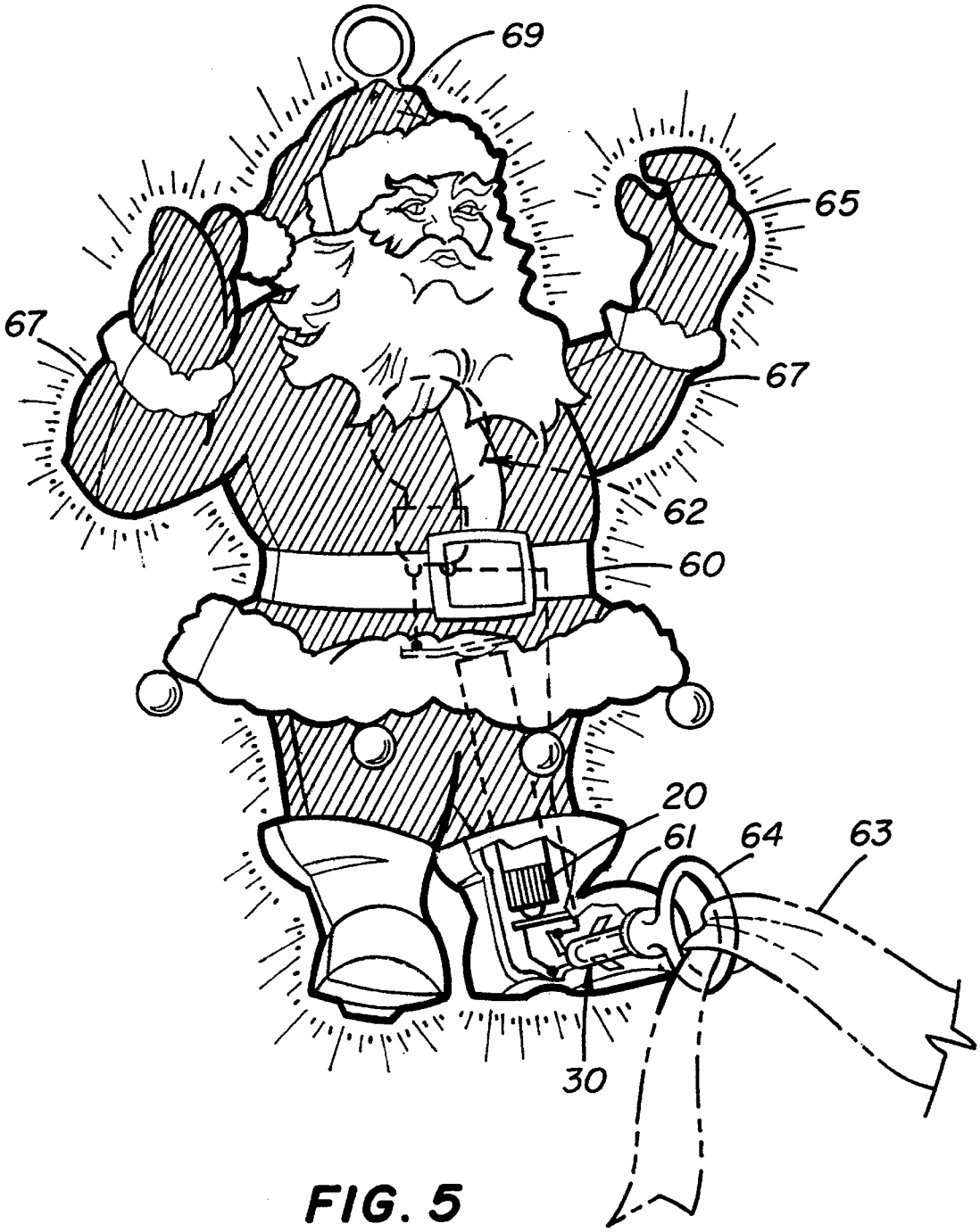
FIG. 5 is a perspective view of a further embodiment of the invention illustrating a three-dimensional hollow recognizable character rendition housing.

Referring now to FIG. 5, there is shown an additional embodiment of the invention. In the noted embodiment, the children's device 65 includes a light transmissive three-dimensional hollow recognizable character rendition housing 60. In this instance, the recognizable character rendition is Santa Claus. However, as will be recognized by one skilled in the art, the recognizable character rendition may comprise a myriad of entities, such as the Easter Bunny and Tooth Fairy, by way of example.

The light transmissive housing 60, illustrated in FIG. 5, similarly includes a light source 62, a conventional battery 20 and a switch 30. The battery 20 and switch 30 are similar in design and configuration as the battery and switch employed in the aforementioned preferred embodiment (i.e., stocking 10).

The battery 20 and switch 30 are preferably removably mounted in the light transmissive housing 60 in the lower portion 61 thereof. As will be apparent to one skilled in the art, the battery 20 and switch 30 may be removably mounted in the light transmissive housing 60 by various conventional means such as velcro strips. In additional, removal and replacement of the battery 20 may be facilitated by providing a conventional hinged opening (not shown) in the lower portion 61 of the light transmissive housing 60 proximate the battery 20. The hinged opening would include a conventional hook closure opposite the hinged ends.

The light source similarly comprises at least one conventional LED (denoted by numeral 62) or light bulb. More preferably, the light source 62 comprises a plurality of LEDs or light bulbs, operatively connected in series as schematically illustrated in FIG. 3. As shown in FIG. 5, the light source 62 is disposed in the interior of the light transmissive housing 60 to illuminate a substantial portion of the housing 60 upon actuation of the switch 30. In further embodiments of the invention, not shown, the light source 62 may be disposed on the exterior of the housing 60.

The illumination device 65, illustrated in FIG. 5, also includes a pull cord 63 to facilitate actuation of the switch 30. The pull cord 63 is similarly attached to the switch pin ring 64 by conventional means. When the illumination device 65 is mounted on the chimney, the pull cord 64 is similarly positioned across the chimney opening. Actuation of the illumination device 65 would thus be similar to the aforementioned preferred embodiment. However, in this instance, when the child awakens on Christmas day, he/she would be greeted by the illuminated Santa Claus.

In additional embodiments, not shown, the illumination device 65 may further include conventional hinge means and electrical (or electro-mechanical) actuation means operatively connected to one or more appendages of the recognizable character rendition. Referring to the Santa Claus illustrated in FIG. 5, by way of example, such appendages may include the arms 67, legs 68 and head 69. In this instance (upon actuation of the switch 30), when the child awakens on Christmas Day, he/she would be greeted by the illuminated, moving Santa Claus with (if desirable) music emanating therefrom.

Without departing from the spirit and scope of this invention, one of ordinary skill can make various changes and modification to the invention to adapt it to various usages and conditions. As such, these changes and modifications are properly, equitably, and intended to be, within the full range of equivalence of the following claims.

What is claimed is:

1. A children's novelty device for detecting when an entity enters a dwelling comprising:

a decorative Christmas stocking having a top portion, a heel portion and a toe portion, said toe portion including an enclosure therein;

an electrical control circuit;

a light source operatively coupled to said control circuit;

a power source operatively coupled to said control circuit for providing power to said light source, said power source being disposed in said toe portion enclosure;

switch means operatively coupled to said control circuit for controlling the power provided by said power source to said light source; and a flexible pull cord, said pull cord being connected to said switch means for actuating said switch means when a force is exerted on said pull cord, whereby, when said pull cord is tugged, said light source is turned on.

2. The device of claim 1 wherein said light source is disposed on the exterior of said stocking.

3. The device of claim 1 wherein said power source comprises a battery.

4. The device of claim 1 wherein two or more stockings are mounted around an entranceway of said dwelling and said pull cords of said stockings are connected, whereby when said pull cords are tugged, said light source of each stocking is turned on.

* * * * *